United States Patent [19]

Ipenburg

[11] Patent Number: 4,946,040

[45] Date of Patent: Aug. 7, 1990

[54] DEVICE FOR FITTING A CONNECTING NIPPLE ON A POUCH

[75] Inventor: Willem Ipenburg, Nieuwegein, Netherlands

[73] Assignee: Chemische Industrie Filoform B.V., Netherlands

[21] Appl. No.: 354,848

[22] Filed: May 22, 1989

[51] Int. Cl.[5] ..... B65D 33/16; B61B 7/24

[52] U.S. Cl. ..... 206/603; 53/410; 53/412; 53/492; 215/11.3; 222/81; 383/66

[58] Field of Search ..... 53/128, 133, 381, 410, 53/412, 451, 492, 551; 206/603; 215/11.3; 220/284; 222/81, 83, 87, 89; 383/66, 86.1, 92

[56] References Cited

U.S. PATENT DOCUMENTS

| | | | |
|---|---|---|---|
| 2,571,144 | 10/1951 | Lobl | 383/66 |
| 3,157,312 | 11/1964 | Kitterman | 53/412 X |
| 3,215,319 | 11/1965 | Laker | 222/478 |
| 3,255,923 | 6/1966 | Soto | 215/11.3 X |
| 3,406,872 | 10/1968 | Fiquet et al. | 222/83 |
| 3,596,801 | 8/1971 | Barnack | 222/81 |
| 4,657,159 | 4/1987 | Grant | 222/83 |
| 4,706,827 | 11/1987 | Cubernoch et al. | 215/11.3 |
| 4,722,850 | 2/1988 | White et al. | 215/11.3 X |
| 4,731,978 | 3/1988 | Martensson | 383/66 X |
| 4,776,488 | 10/1988 | Gurzan | 222/81 |
| 4,785,857 | 11/1988 | Baars | 138/89 X |

*Primary Examiner*—John Sipos
*Assistant Examiner*—Beth Bianca
*Attorney, Agent, or Firm*—Griffin, Branigan & Butler

[57] ABSTRACT

A method and a device for sealingly fitting a connecting nipple on a pouch by means of an adhesive layer and opening the pouch at the location of the nipple. The nipple is fitted on the exterior of a wall of the at least partly filled pouch, after a cover layer has been removed therefrom. A pusher member having a piercing element is also fitted on the exterior of the pouch wall. The pusher member is used to force a passage in the wall of the pouch adjacent the connecting nipple by pushing.

5 Claims, 1 Drawing Sheet

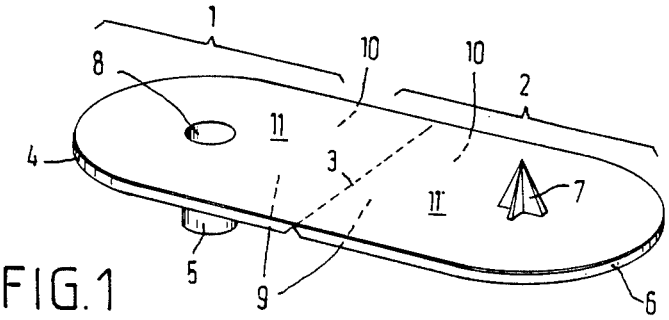
FIG.1
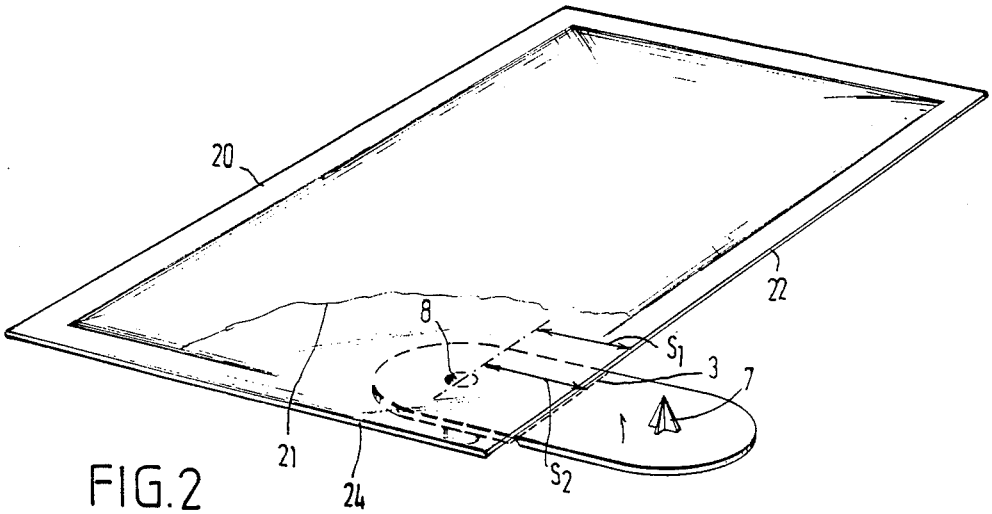
FIG.2
FIG.3
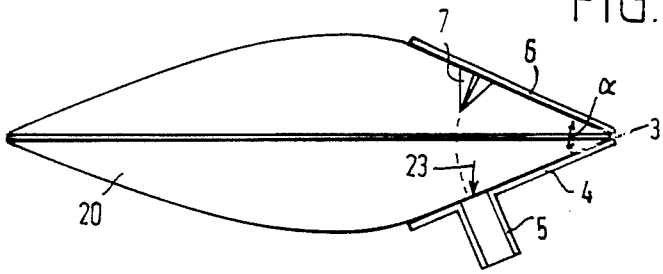

DEVICE FOR FITTING A CONNECTING NIPPLE ON A POUCH

This invention relates to a method of sealingly fitting a connecting nipple on a pouch by means of an adhesive layer and opening said pouch at the location of said nipple, the method comprising fitting the connecting nipple on the exterior of a wall of the at least partly filled pouch, after removal of a cover layer from said nipple, and to a device for performing such a method.

A similar method is known from Dutch patent application 86.00619, U.S. equivalent Pat. No. 4,785,857. The method described therein relates to the fitting of a connecting nipple on a pouch containing a foamable liquid. The foaming liquid presses the wall of the pouch against tearing elements of the nipple, which face the wall, so that at the location of the nipple, a passage is forced in the wall of the pouch. When, however, no foamable plastic is contained in the pouch, this method cannot be used without employing aids, such as a pump.

It is an object of the present invention to provide a method wherein the above problems are solved in a simple and hygienic manner, and a device for performing the method.

To that end, the method according to the present invention is characterized in that a pusher member having a piercing element is fitted on the exterior of the pouch wall, with which pusher member a passage is forced in the wall of the pouch adjacent the nipple by pushing.

A device for performing the method according to the present invention is characterized according to the invention in that the pusher member comprises at least a first portion and a second portion, said first portion being substantially flat, said second portion, serving for forcing a passage in the wall of the pouch wall, being substantially perpendicular to said first portion and tapering off to an end suitable for piercing the pouch wall in cooperation with the connecting nipple.

It may be advantageous when the connecting nipple is provided with tearing elements. In a preferred embodiment of the present invention, the second portion of the pusher member is constructed as a sharp and/or pointed piercing element.

To prevent the contents of the pouch from being lost when the pouch wall is pierced at the location of the pusher member, the attachment portion of the pusher member may be provided on the side of the piercing element with an adhesive layer for sealing attachment to the pouch, which ensures that the liquid can be discharged from the pouch without the user's hands coming into contact with the liquid.

In another preferred embodiment of the present invention, the connecting nipple and the pusher member are integrated, with a connecting portion having a fold line and/or a line of fracture. The integral design and the provision of a fold line ensure that the piercing element is always at the proper location opposite the connecting nipple, and thus prevent the wall of the pouch from being inadvertently pierced in the wrong place relative to the nipple. By providing a line of fracture, it is ensured that the connection between the nipple and the pusher member can be broken after the passage has been forced, thus preventing the combination of nipple and pusher member from impeding a proper outflow of the contents from the pouch. This effect can be enhanced still further by imparting to the assembly of connecting nipple and pusher member near the fold line and/or line of fracture such resilience that, before the connection between nipple and pusher member is broken, the piercing element, after the passage has been forced, springs back from the passage, to thus clear the passage.

For effecting the sealing attachment of the connecting nipple and the pusher member to the respective pouch wall, the nipple and the pusher member can be provided with an adhesive layer, which adhesive layers may be one continuous layer. Said adhesive layer may be fitted with a removable cover strip.

One embodiment of the device according to the present invention will now be described, by way of example, with reference to the accompanying drawings, in which:

FIG. 1 is a perspective view of a preferred embodiment of the device according to the present invention;

FIG. 2 is a corresponding view of the device shown in FIG. 1 in combination with a pouch; and FIG. 3 is a cross-sectional view of the pouch shown in FIG. 2 with a device according to FIG. 1 fitted thereon in operative position.

FIG. 1 shows a connecting nipple 1 and a pusher member 2, interconnected by a fold line and/or line of fracture 3. Nipple 1 includes a first portion 4, serving for fitting the nipple on the pouch and being substantially flat, and a nipple second portion 5, serving for connecting a hose or the like, not shown. The attachment portion 4 has a passage 8 at the location of the second portion 5.

The pusher member comprises a first portion 6, serving for fitting the pusher element on the pouch and being substantially flat, and a second portion 7, serving for forcing a passage in the pouch wall. Attachment portion 4 of nipple 1 and attachment portion 6 of pusher member 2 are connected by the said fold line and/or line of fracture 3. The second portion 5 of nipple 1 and the piercing element 7 of pusher member 2 are situated at opposite sides 9, 10 of the plane defined by the two attachment portions 4, 6. The entire area 10 is provided with an adhesive layer 11 and a removable cover strip, not shown.

The piercing element 7 of pusher member 2 is substantially perpendicular to the attachment portion 6 and tapers off to a sharp point. The drawings show the piercing element 7 in the form of a plurality of right-angled triangles, which are attached to each other by one of their legs. It will be clear that other shapes suitable for piercing can be used, and that the scope of protection of the present invention is not restricted to the shape of the piercing element 7 of pusher member 2 shown in the figure.

FIG. 2 shows a pouch 20 at least partly filled with a liquid 21. After removal of the cover strip from adhesive layer 11, connecting nipple 1 is stuck with adhesive layer 11 against the wall of pouch 20. It should be ensured that the distance S1 between the passage and the edge 22 of the pouch is smaller than the distance S2 between the said passage 8 and the fold line and/or line of fracture 3, in order to prevent the pouch from being folded upon itself between the nipple and the piercing element, thereby jeopardizing the sealing effect of the layer 11 or even piercing the pouch in several unwanted places. It should also be ensured that the passage 8 is not kept too close to the edge 22 and/or 24 of pouch 20 during the piercing, because in that case as well, the sealing effect of layer 11 gets lost. If desired, the assembly of nipple and pusher member, prior to the fitting of nipple 1 against the wall of pouch 20, can be pre-folded along the fold line and/or line of fracture 3, so that the V-shape shown in FIG. 3 is assumed. The fold line and/or line of fracture 3 can then be used as a stop for edge 22 of pouch 20.

After fitting connecting nipple 1 against the wall of pouch 20, pusher member 2 is folded (further) about the fold line and/or line of fracture 3 in such a manner that the angle $\alpha$ between the attachment portion 4 of nipple 1 and the attachment portion 6 of pusher member 2 becomes increasingly smaller. As the distance S3 between piercing element 7 of pusher member 2 and fold line and/or line of fracture 3 is (substantially) equal to the distance S2, piercing element 7 will be located exactly opposite passage 8 when piercing element 7 contacts pouch 20. Under the influence of the pinching force, adhesive layer 11 will now effect the sealing attachment between pusher member 2 and pouch 20, and piercing element 7 of pusher member 2 will force a passage 23 in the wall of pouch 20. When the pinching force is reduced, the assembly of nipple and pusher member will spring apart, since it is resilient at the fold line and/or line of fracture 3, thus enlarging again the angle $\alpha$ and resuming the V-shape shown in FIG. 3. The piercing element 7 is then retracted from passage 23, thereby clearing the same. Likewise, pouch 20 is pulled open, as shown in FIG. 3, due to the recoil whereby the distance between the nipple and the pusher member is increased. All this ensures that the liquid 21 can be effectively discharged from pouch 20 through the passages 23 and 8.

If, through whatever cause, the pressure in pouch 20 becomes too high, pouch 20 will be forced to assume as much as possible a spherical shape. If the connecting nipple and pusher member should form a rigid assembly, this would prevent pouch 20 from assuming a spherical shape, so that the pouch could be torn loose from the attachment portions 4 and/or 6. As, however, according to the present invention, the assembly of connecting nipple and pusher member can be broken along the line of fracture 3, the pouch can assume the desired shape without impediment.

What I claim is:

1. A device for sealingly fitting a nipple on the outside of a flexible pouch having opposed, flexible side walls, comprising:

(1) a pusher member having a substantially flat first portion and a piercing element attached thereto, said piercing element being substantially perpendicular to said flat first portion and having an upstanding, tapered terminating end which is suitable for piercing at least one pouch side wall and forming a passage therethrough;

(2) a connecting nipple having a substantially flat first portion for engaging the opposite pouch sideway, a passageway disposed substantially perpendicularly therethrough, and a nipple second portion communicating with said passageway and forming a connection for a hose or the like;

(3) a fold line portion connecting the pusher member and the connecting nipple so as to form an integral unit thereof and said pusher member and the connecting nipple being foldable about said fold line; and wherein the piercing element and the nipple second portion are disposed on opposite sides of said integral unit and equally spaced from said fold line.

2. A device as claimed in claim 1, characterized in that the piercing element of the pusher member has a sharp and/or pointed terminating end.

3. A device as claimed in claim 1, characterized in that the first portion of the pusher member is provided on the side thereof having the piercing element with an adhesive layer for sealing attachment to the pouch side wall.

4. A device as claimed in claim 1, characterized in that the integral unit of the connecting nipple and pusher member is resilient at the location of the fold line line.

5. A device as claimed in claim 3, characterized in that the adhesive layer is extended to cover the first portion of the connection nipple and that the resulting entire adhesive layer has a continuous cover layer thereon so as to provide one continuous removable cover layer.

* * * * *